US010777032B2

(12) United States Patent
Cao et al.

(10) Patent No.: US 10,777,032 B2
(45) Date of Patent: Sep. 15, 2020

(54) METHOD AND DEVICE FOR CORRECTING DEVIATION OF PAPER MEDIUM, AND FINANCIAL SELF-SERVICE DEVICE

(71) Applicant: GRG BANKING EQUIPMENT CO., LTD., Guangzhou, Guangdong (CN)

(72) Inventors: Guozhong Cao, Guangdong (CN); Tiancai Liang, Guangdong (CN); Hongjun Wu, Guangdong (CN); Keye Li, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 4 days.

(21) Appl. No.: 15/747,705

(22) PCT Filed: Apr. 29, 2016

(86) PCT No.: PCT/CN2016/080652
§ 371 (c)(1),
(2) Date: Jan. 25, 2018

(87) PCT Pub. No.: WO2017/016256
PCT Pub. Date: Feb. 2, 2017

(65) Prior Publication Data

US 2018/0218557 A1 Aug. 2, 2018

(30) Foreign Application Priority Data

Jul. 27, 2015 (CN) ..... 2015 1 0448112

(51) Int. Cl.
*B65H 5/06* (2006.01)
*G07D 11/17* (2019.01)
(Continued)

(52) U.S. Cl.
CPC ..... *G07D 11/17* (2019.01); *B65H 5/062* (2013.01); *B65H 9/166* (2013.01); *G07D 11/16* (2019.01);
(Continued)

(58) Field of Classification Search
CPC .. B65H 2404/1312; B65H 2404/13171; B65H 5/062; B65H 2404/1315
See application file for complete search history.

(56) References Cited

U.S. PATENT DOCUMENTS

| | | | | |
|---|---|---|---|---|
| 3,175,824 | A | 3/1965 | Albosta | |
| 5,507,482 | A | 4/1996 | Tenpaku et al. | |
| 6,045,220 | A | 4/2000 | Kiyohara et al. | |
| 2005/0252975 | A1* | 11/2005 | Furihata | G06K 13/16 235/475 |

(Continued)

FOREIGN PATENT DOCUMENTS

| | | | |
|---|---|---|---|
| CN | 1124711 | A | 6/1996 |
| CN | 1990367 | A | 7/2007 |

(Continued)

OTHER PUBLICATIONS

International Search Report for PCT/CN2016/080652, dated Aug. 3, 2016, ISA/CN.

(Continued)

*Primary Examiner* — Howard J Sanders
(74) *Attorney, Agent, or Firm* — Yue (Robert) Xu; Apex Attorneys at Law, LLP

(57) ABSTRACT

A paper medium skew correcting device includes: a support including a pair of fixed stop plates arranged in parallel; a skew correcting tapered roller assembly including a tapered roller, a reference plate located at a large end face of the tapered roller and a transmission shaft; a tapered cover plate covering on the tapered roller with a skew correcting passage formed between an inner wall of the tapered cover plate and an outer wall of the tapered roller, an auxiliary pressure roller mechanism is mounted on an outer wall of the tapered
(Continued)

cover plate and is configured to press a paper medium against the outer wall of the tapered roller tightly, the tapered cover plate is provided with an opening; and a driving transmission assembly. The device fully uses combined action of centrifugal force and friction force to realize skew correction and conveying of the paper medium.

11 Claims, 8 Drawing Sheets

(51) Int. Cl.

| | |
|---|---|
| ***B65H 9/16*** | (2006.01) |
| ***G07F 19/00*** | (2006.01) |
| ***G07G 5/00*** | (2006.01) |
| ***G07D 11/16*** | (2019.01) |

(52) U.S. Cl.
CPC ..... *G07F 19/20* (2013.01); *G07F 19/201* (2013.01); *G07G 5/00* (2013.01); *B65H 2403/20* (2013.01); *B65H 2403/25* (2013.01); *B65H 2404/1312* (2013.01); *B65H 2404/1531* (2013.01); *B65H 2404/16* (2013.01); *B65H 2404/612* (2013.01); *B65H 2701/1912* (2013.01)

(56) References Cited

U.S. PATENT DOCUMENTS

| | | | | |
|---|---|---|---|---|
| 2007/0007719 | A1* | 1/2007 | Nishida ..... | B65H 9/166 271/228 |
| 2016/0055700 | A1 | 2/2016 | Wang et al. | |
| 2017/0260016 | A1 | 9/2017 | Tan et al. | |

FOREIGN PATENT DOCUMENTS

| | | | | |
|---|---|---|---|---|
| CN | 201842525 | U | | 5/2011 |
| CN | 103236120 | A | | 8/2013 |
| CN | 203512663 | U | | 4/2014 |
| CN | 103950757 | A | | 7/2014 |
| CN | 104200581 | A | | 12/2014 |
| CN | 104418037 | A | | 3/2015 |
| CN | 105096476 | A | | 11/2015 |
| EP | 0496398 | A2 | | 7/1992 |
| JP | 2009057174 | A | * | 3/2009 |
| KR | 10-0804134 | B1 | | 2/2008 |
| KR | 100959154 | B1 | | 5/2010 |
| WO | 2012042622 | A1 | | 4/2012 |

OTHER PUBLICATIONS

Extended search report dated Jul. 19, 2018 for European application No. 16829623.4, 5 pages.

* cited by examiner

METHOD AND DEVICE FOR CORRECTING DEVIATION OF PAPER MEDIUM, AND FINANCIAL SELF-SERVICE DEVICE

This application is the national phase of International Application No. PCT/CN2016/080652, titled "METHOD AND DEVICE FOR CORRECTING DEVIATION OF PAPER MEDIUM, AND FINANCIAL SELF-SERVICE DEVICE", filed on Apr. 29, 2016 which claims the benefit of priority to Chinese patent application No. CN201510448112.8 titled "METHOD AND DEVICE FOR CORRECTING PAPER MEDIUM SKEW AND FINANCIAL SELF-SERVICE APPARATUS", filed with the Chinese State Intellectual Property Office on Jul. 27, 2015, the entire disclosures of which applications are incorporated herein by reference.

FIELD

The present application relates to a conveying auxiliary device for a paper medium, and more specifically to a conveying device for correcting skew of valuable paper mediums such as banknotes and checks.

BACKGROUND

The ATMs, cash counters and other paper medium conveying devices are all required to be equipped with a skew correcting device integrated with the conveying device in order to ensure that banknotes and other valuable paper mediums are conveyed in the machine tidily without being skewed. A skew correcting mechanism in the conventional technical solution has a guiding device for guiding horizontal movement of banknotes, a driving roller for providing power to the movement of banknotes, a pinch roller in contact with the banknotes and performing skew correction and a supporting frame thereof, and other accessories. The conventional device has disadvantages of a large size, difficult adjusting of the skew correcting force, being apt to over-correct the skew of old banknotes, and further causing jam of the valuable banknotes in the device, which adversely affects the utilization efficiency of the conveying device seriously, and is extremely apt to cause damage of the banknotes due to the jam of the banknotes in the device, and increases extra loss.

In view of the disadvantages of the conventional skew correcting device, the technical solution in the invention of "SKEW CORRECTING MECHANISM" with the application number of 20051121474.2 has a correcting force adjusting device added on the basis of the conventional solutions and can relatively freely adjust the correcting force acting on the paper mediums, and overcome the deficiency of a constant correcting force in the conventional technical solutions; the technical solution in the invention of "AUTOMATIC TELLER MACHINE AND SKEW CORRECTING DEVICE THEREOF" with the application number of 201310143787.2 includes a banknote movement track consisting of two layers of passage plates, a driving roller, a skew correction adjusting roller and a transmission device thereof. The skew correction function for banknotes is achieved by cooperation of a reference wall, the skew correction adjusting roller and the driving roller, thus achieving a direct effect of the skew correcting roller to the banknotes and reducing a transmitting space for correcting skew of banknotes, and reducing the size of the device significantly.

Although the solution in the existing patents can perform correction of skewed paper mediums in conveyance, the technical solution has disadvantages of a complex structure and more parts and components, and high manufacturing and assembling costs.

SUMMARY

In order to address the issues of complex structure and high manufacturing costs of the skew correcting device in the conventional technology, a paper medium skew correcting device and a financial self-service apparatus are provided according to the present application, which can effectively correct and convey skewed mediums, while ensuring the reliability of the device, simplifies the structure of the device and reduces manufacturing and assembling costs of the device as much as possible, and also minimizes the size of the device as much as possible to facilitate the integration of the device in ATMs and cash counters.

A paper medium skew correcting method is further provided according to the present application.

A paper medium skew correcting device according to the present application includes: a support including a pair of fixed stop plates arranged in parallel and configured to fixedly mount the following components; a skew correcting tapered roller assembly including a tapered roller, a reference plate located at a large end face of the tapered roller, and a tapered roller transmission shaft, specifically, the skew correcting tapered roller assembly is fitted to transmission shaft mounting holes of the pair of fixed stop plates on a left side and a right side by the tapered roller transmission shaft; a tapered cover plate covering on the tapered roller, with a paper medium skew correcting passage formed between an inner wall of the tapered cover plate and an outer wall of the tapered roller, specifically, an auxiliary pressure roller mechanism is mounted on an outer wall of the tapered cover plate, and is configured to press a paper medium in the skew correcting passage against the outer wall of the tapered roller tightly, the tapered cover plate is provided with an opening for the auxiliary pressure roller mechanism to elastically press the tapered roller tightly; and a driving transmission assembly, for providing power to the tapered roller.

Preferably, the paper medium skew correcting device further includes an entrance leading passage. The entrance leading passage includes a horizontal passage interface and an inclined turning passage, an inner wall of the inclined turning passage is a smooth curved surface and is tangentially connected to an inner wall of the horizontal passage and the inner wall of the tapered cover plate.

Further, the entrance leading passage further includes a driving banknote picking roller, a guide driven pinch roller and a turning driven roller in the listed sequence in the conveying direction of paper medium. The driving banknote picking roller is connected to the pair of fixed stop plates on the two sides by a fixed shaft, the driving banknote picking roller is in contact with the guide driven pinch roller through a roller slot in the horizontal passage interface, and the turning driven pinch roller is connected to the pair of fixed stop plates on the two sides by an inclined shaft, and the turning driven pinch roller is in contact with the tapered roller through a roller slot in the inclined turning passage.

Preferably, the paper medium skew correcting device further includes an exit transfer passage. The exit transfer passage includes a horizontal turning passage and an outward transfer horizontal passage, an inner wall of the horizontal turning passage is a smooth curved surface and is tangentially connected to the inner wall of the tapered cover plate and the outward transfer passage.

Further, the exit transfer passage further includes a driving delivery roller and a slant driven pinch roller, the driving delivery roller is connected to the pair of fixed stop plates on the left side and the right side by a shaft, and the driving delivery roller is in contact with an inner wall of the outward transfer horizontal passage through a roller slot in the outward transfer horizontal passage; and the slant driven pinch roller is connected to the pair of fixed stop plates on the left side and the right side by an inclined shaft; and the slant driven pinch roller is in contact with the tapered roller through a roller slot in the tapered cover plate.

Preferably, the auxiliary pressure roller mechanism includes a pressure roller seat and an auxiliary pressure roller, a pressure roller shaft and a pressing force adjusting spring, and the auxiliary pressure roller mechanism is mounted to a fitting hole in the tapered cover plate via the pressure roller seat, and the auxiliary pressure roller is in contact with the tapered roller through a roller slot in the tapered cover plate, and the pressing force adjusting spring has one end fixed to the pressure roller seat and another end connected to the auxiliary pressure roller, and the pressing force adjusting spring is configured to adjust the pressure of the auxiliary pressure roller acting on the tapered roller.

A paper medium skew correcting method according to the present application, includes:

step 1, entering a paper medium to be corrected into the entrance leading passage of the above paper medium skew correcting device, and entering the paper medium into the paper medium skew correcting passage between the tapered cover plate and the tapered roller via the horizontal passage interface and the inclined turning passage;

step 2, sliding, by a co-action of a centrifugal force and a rotational kinetic friction force of the tapered roller, the paper medium towards a large end of the tapered roller, and when an edge of the paper medium fits the large end surface reference plate, the paper medium stops moving axially due to being blocked by the large end surface reference plate, thus achieving the skew correction to the paper medium during conveying and moving process; and step 3, entering the paper medium into the outward transfer passage via the horizontal turning passage, thus outputting the skew-corrected paper medium.

Preferably, in step 1, the paper medium in the horizontal passage interface enters the inclined turning passage under the action of the driving banknote picking roller and the guide driven pinch roller, and then enters the paper medium skew correcting passage between the tapered cover plate and the tapered roller under the action of the turning driven pinch roller; and in step 3, when the paper medium enters the horizontal turning passage from the skew correcting passage, the slant driven pinch roller acts on the paper medium to prevent the paper medium from being skewed again, and the driving delivery roller provides power to realize the output of the skew-corrected paper medium.

Preferably, in step 2, the auxiliary pressure roller mechanism acts on the surface of the tapered roller, to apply a pressure on the paper medium passing through the paper medium skew correcting passage and guide the paper medium, to prevent the paper medium from separating from the outer surface of the tapered roller due to the action of the centrifugal force generated when the paper medium moves in the skew correcting passage.

A financial self-service apparatus is further provided according to the present application, which includes: a banknote access slot for depositing and/or withdrawing of banknotes; a banknote receiving box for storing banknotes; and a banknote conveying passage configured to connect the banknote access slot and the banknote receiving box and convey banknotes. The banknote conveying passage is provided with the above paper medium skew correcting device.

The paper medium skew correcting device according to the present application has the following beneficial effects compared with the conventional skew correcting device.

The paper medium skew correcting device according to the present application adopts the tapered roller assembly to achieve skew correction of banknotes. The tapered roller and the tapered cover plate in the tapered roller assembly cooperate to form the paper medium skew correcting passage. The power for movement of banknotes in the skew correcting passage is only provided by the driving transmission assembly. Since the skew correcting passage formed by the tapered roller and the tapered cover plate is around the tapered roller, the skew correcting passage does not occupy a large space in a horizontal direction, and the tapered roller has a simple structure, and is easy to assemble. Therefore, the paper medium skew correcting device according to the present application effectively simplifies the structure, reduces the manufacturing and assembling costs of the products, and fully utilizes the co-action of the centrifugal force and friction force generated in the movement of the paper medium along with the tapered roller to achieve skew correction and conveyance of the paper medium, thereby fundamentally overcoming the technical issue of jam of valuable paper medium in the device due to a too large skew correcting force. Also, since the structure is simplified, the device can effectively reduce the volume, and facilitates the integration of the device in other apparatuses such as the ATMs and cash counters.

DETAILED DESCRIPTION

The components of the paper medium skew correcting device and the working principle thereof are described hereinafter with reference to the drawings.

Figure 1:
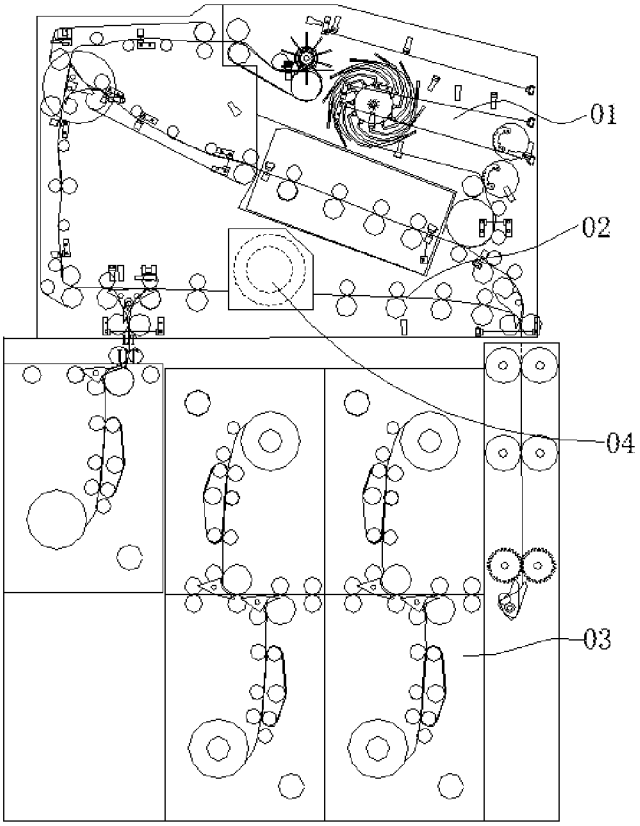
FIG. 1 is a schematic view of a financial self-service apparatus having a skew correcting device.

As shown in FIG. 1, which is a schematic view of the components of a financial self-service apparatus according to the present application, the financial self-service apparatus includes a banknote access slot 01 for depositing and/or withdrawing banknotes, a banknote receiving box 03 for storing banknotes, a banknote conveying passage 02 which connects the banknote access slot 01 and the banknote receiving box 03 to convey banknotes. The banknote conveying passage 02 is provided with a paper medium skew correcting device 04 capable of correcting banknote skew in the banknote conveying passage. The financial self-service apparatus further includes an identification module for identifying banknotes and a necessary control module (not illustrated), and all of these modules are the same as related modules of a conventional financial apparatus, and are not described here.

Figure 2:
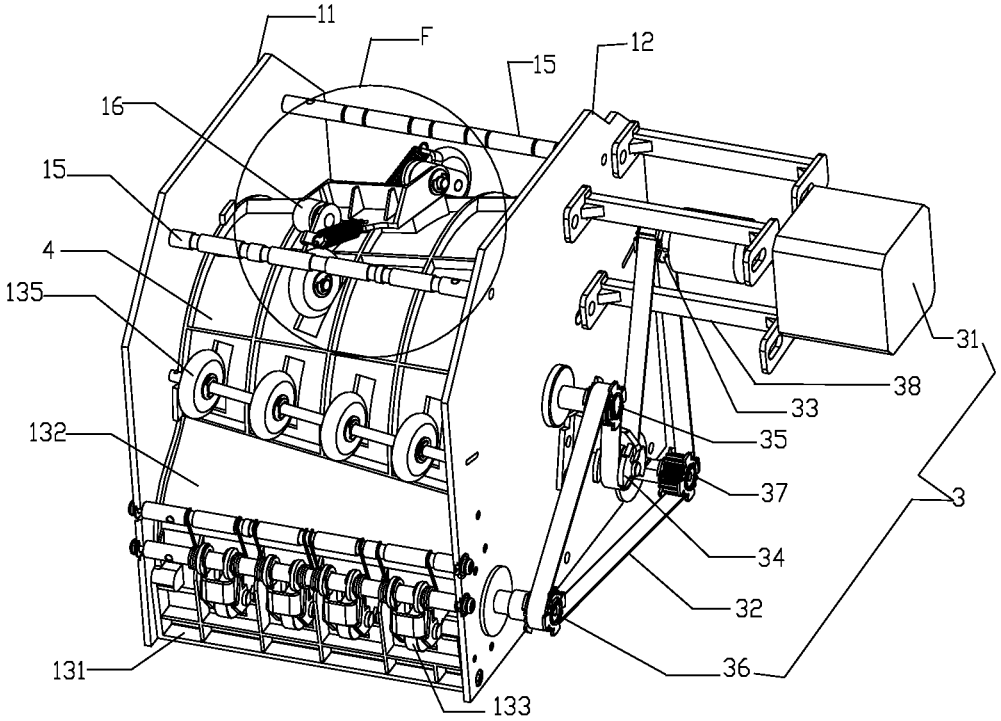
FIG. 2 is a schematic perspective view showing the structure of a paper medium skew correcting device according to a preferred embodiment of the present application.
Figure 4:
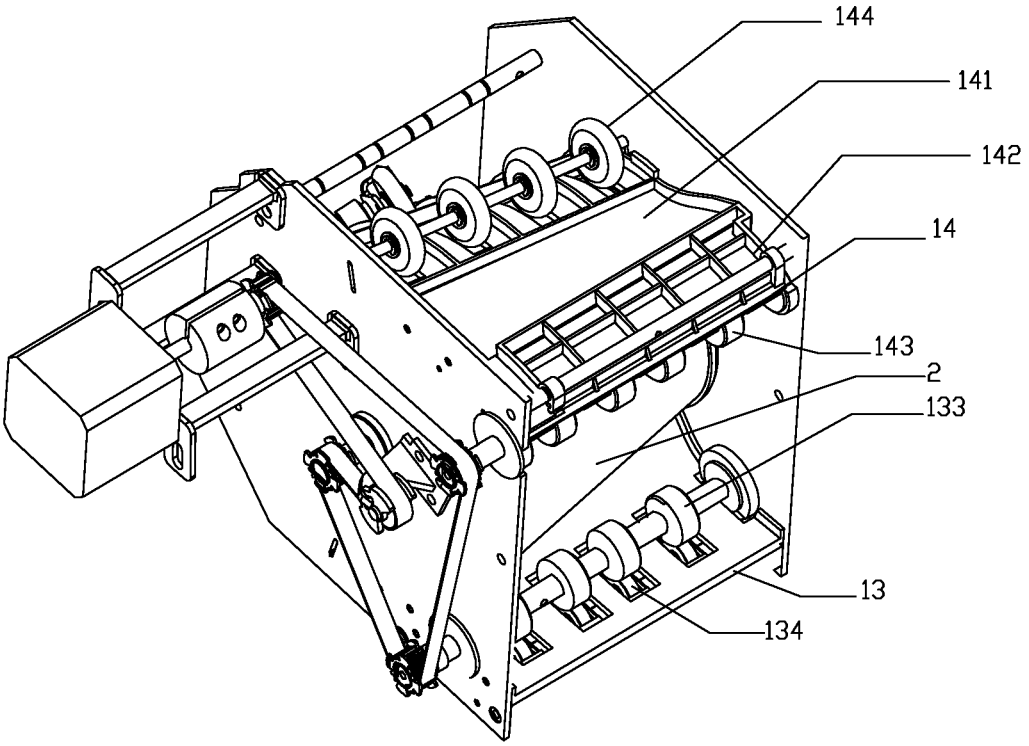
FIG. 4 is a side view of the paper medium skew correcting device in FIG. 1.

As shown in FIG. 2 and FIG. 4, a paper medium skew correcting device 04 according to this embodiment includes a support, an entrance leading passage 13, an exit transfer passage 14, a skew correcting tapered roller assembly, a tapered cover plate 4 and a driving transmission assembly 3, an outer wall of the tapered cover plate 4 is mounted with an auxiliary pressure roller mechanism 16.

The support includes a pair of fixed stop plates 11 and 12 arranged in parallel and at least one stop plate supporting shaft 15 located between the pair of fixed stop plates for supporting the pair of fixed stop plates. The support is a supporting frame for the paper medium skew correcting device, and other parts and components are arranged between the pair of fixed stop plates 11, 12 or fixed on one of the fixed stop plates. The driving transmission assembly 3 is arranged at an outer side of the stop plate 12 for providing power to the paper medium skew correcting device. The driving transmission assembly 3 includes a driving motor 31, a synchronous belt 32, a driving synchronous pulley 33, a tapered roller synchronous pulley 34, a tensioning guide synchronous pulley 35, a driving banknote picking pulley 36, a driving banknote conveying pulley 37 and at least one motor supporting shaft 38.

The entrance leading passage 13 includes a horizontal passage interface 131, an inclined turning passage 132, a driving banknote picking roller 133, a guide driven pinch roller 134, and a turning driven roller 135 in the listed sequence in a paper medium conveying direction. The horizontal passage interface 131 and the inclined turning passage 132 are connected to the fixed stop plates 11 and 12 on the two sides by screws. The driving banknote picking roller 133 is connected to the fixed stop plates 11 and 12 on the two sides by a fixed shaft, and the driving banknote picking roller 133 is in contact with the guide driven pinch roller 134 via a roller slot in the horizontal passage interface 131. The turning driven pinch roller 135 is connected to the fixed stop plates 11, 12 on the left and right sides through an inclined shaft, and the turning driven pinch roller 135 is in contact with the tapered roller 21 through a roller slot in the inclined turning passage 132.

The exit transfer passage 14 includes a horizontal turning passage 141, an outward transfer horizontal passage 142, a driving delivery roller 143 and a slant driven pinch roller 144. The horizontal turning passage 141 and the outward transfer horizontal passage 142 are connected to the fixed stop plates 11 and 12 on the two sides by screws. The driving delivery roller 143 is connected to the fixed stop plates 11 and 12 on the left and right sides by a shaft. The driving delivery roller 143 is in contact with an inner wall of the outward transfer horizontal passage 142 through a roller slot in the outward transfer horizontal passage 142. The slant driven pinch roller 144 is connected to the fixed stop plates 11, 12 on the left and right sides through an inclined shaft; and the slant driven pinch roller 144 is in contact with the tapered roller 21 through a roller slot 41 in the tapered cover plate 4.

Figure 5:
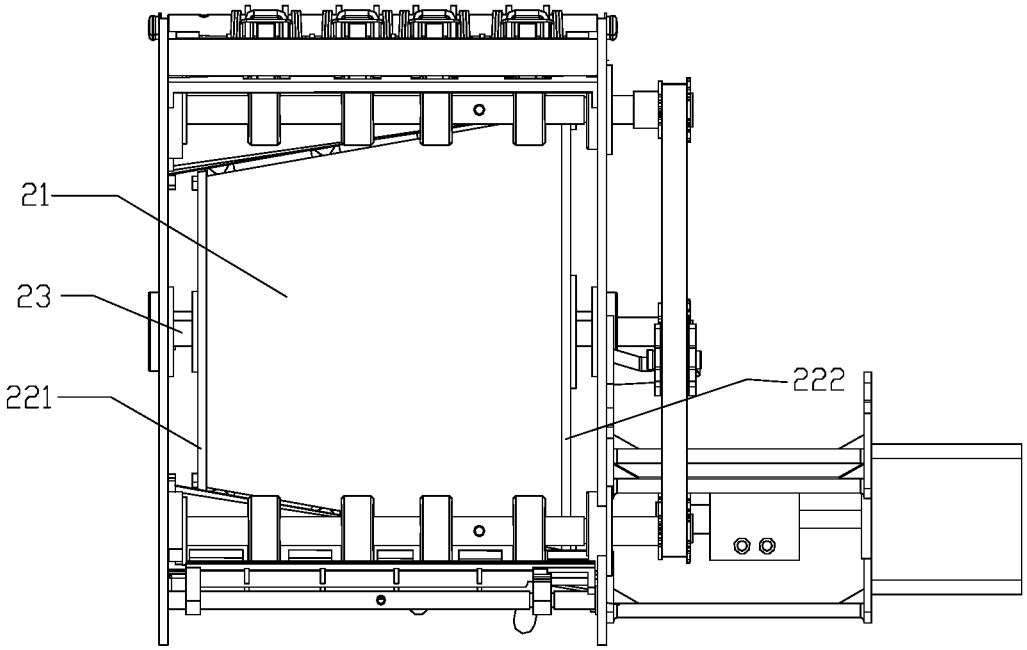
FIG. 5 is a bottom view of the paper medium skew correcting device in FIG. 1.
Figure 6:
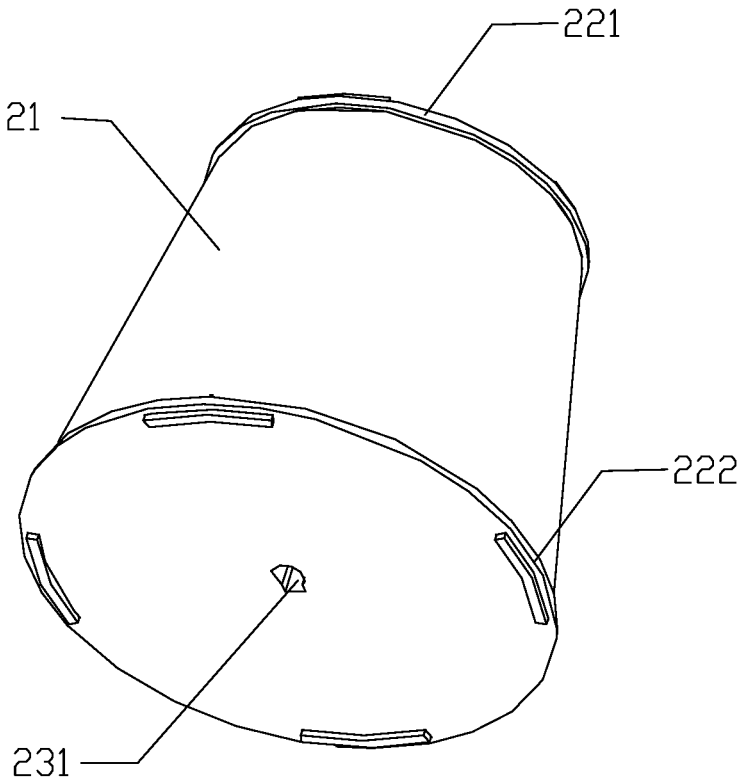
FIG. 6 is a schematic perspective view showing the structure of a tapered roller of the paper medium skew correcting device in FIG. 1.

As shown in FIG. 5 and FIG. 6, the skew correcting tapered roller assembly is located between the entrance leading passage 13 and the exit transfer passage 14, and includes a tapered roller 21, a large end face reference plate 222 and a small end face reference plate 221 located on two ends of the tapered roller and a tapered roller transmission shaft 23. The skew correcting tapered roller assembly is fitted and connected to transmission shaft mounting holes of the pair of fixed stop plates 11 and 12 on the left and right sides by the tapered roller transmission shaft 23.

Figure 7:
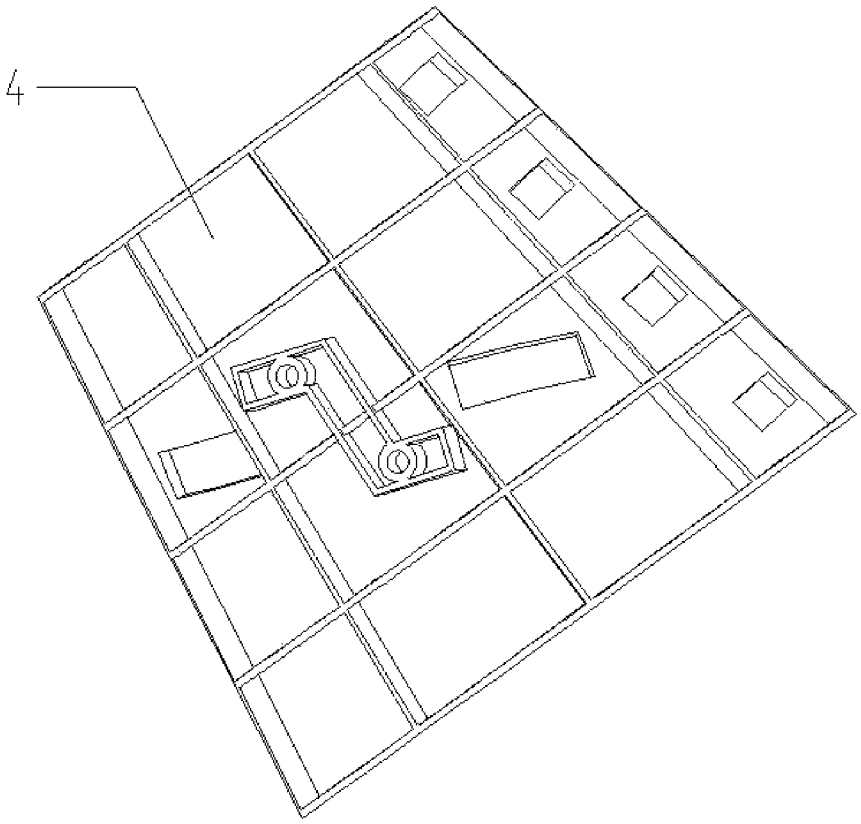
FIG. 7 is a schematic perspective view showing the structure of a tapered cover plate of the paper medium skew correcting device in FIG. 1.
Figure 8:
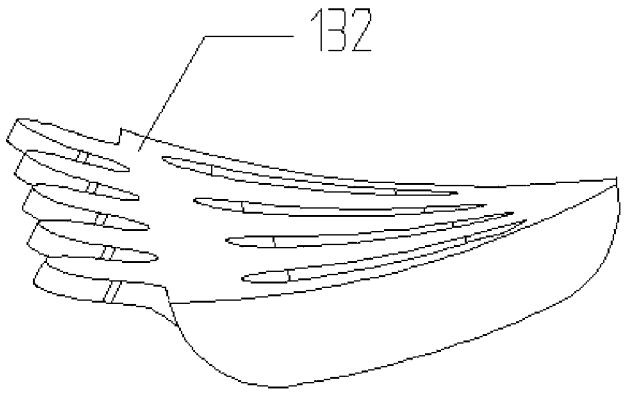
FIG. 8 is a side view of an inclined turning passage of the paper medium skew correcting device in FIG. 1.

As shown in FIG. 7, the tapered cover plate 4 has a shape as illustrated by the figure, the two sides of the tapered cover plate 4 are fixedly connected to the pair of fixed stop plates 11, 12 respectively, the tapered cover plate 4 covers the tapered roller 21, and a gap between an inner wall of the tapered cover plate 4 and an outer wall of the tapered roller 21 forms a paper medium skew correcting passage. At an entrance side in the paper medium conveying direction, as shown in FIG. 8, an inner wall of the inclined turning passage 132 is a smooth curved surface, and the inclined turning passage 132 has one side connected to the horizontal passage interface 131 and another side connected to the tapered roller 21. The inclined turning passage 132 is configured to connect the horizontal passage interface 131 to the paper medium skew correcting passage. Similarly, at an exit side in the paper medium conveying direction, an inner wall of the horizontal turning passage 141 is a smooth curved surface, and the horizontal turning passage 141 has one side connected to the tapered cover plate 4 and another side connected to the outward transfer horizontal passage 142. The horizontal turning passage 141 is configured to connect the paper medium skew correcting passage to the outward transfer horizontal passage 142. In addition, in order to ensure the smooth movement of the paper mediums, the inner smooth curved surface of the inclined turning passage 132 is tangent to the inner curved surface of the horizontal passage interface 131 at a position where the inclined turning passage is connected to the horizontal passage interface 131. The smooth curved surface of the inner wall of the inclined turning passage 132 is tangent to a curved surface of the inner wall of the tapered cover plate 4 at a position where the inclined turning passage is connected to the tapered roller 21. Similarly, in order to ensure the smooth movement of the paper mediums, the smooth curved surface of the inner wall of the horizontal turning passage 141 is tangent to the inner wall of the tapered cover plate 4 at a position where the horizontal turning passage is connected to the tapered cover plate 4, the smooth curved surface of the inner wall of the horizontal turning passage 141 is tangent to the inner wall of the outward transfer passage 142 at a position where the horizontal turning passage is connected to the outward transfer passage 142.

Figure 3:
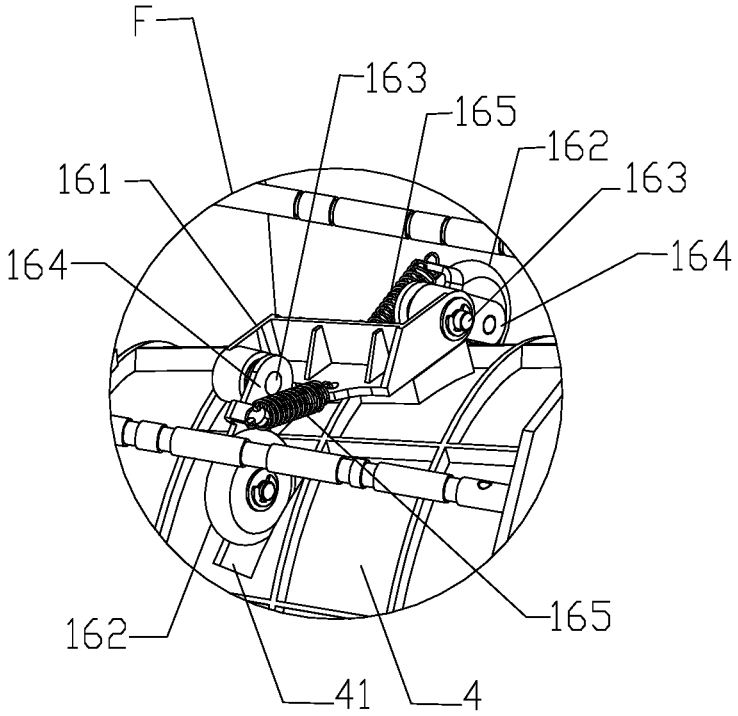
FIG. 3 is an enlarged view of a part F in FIG. 1.

Referring to FIG. 2 and FIG. 3, the auxiliary pressure roller mechanism 16 is configured to press the paper medium in the skew correcting passage against an outer wall of the tapered roller 21, and the tapered cover plate 4 is provided with an opening for the auxiliary pressure roller mechanism 16 to elastically press against the tapered roller 21, that is, the roller slot 41. The auxiliary pressure roller mechanism 16 includes a pressure roller seat 161, a pair of auxiliary pressure rollers 162 arranged symmetrically, a pair of pressure roller shafts 163, a pair of pressure roller brackets 164, and a pair of pressing force adjusting springs 165. The auxiliary pressure roller mechanism 16 is mounted to a fitting hole in the tapered cover plate 4 by the pressure roller seat 161. In this embodiment, the pair of symmetrical auxiliary pressure rollers 162 is provided, therefore, the pressure roller seat has a z-shaped structure. Each of two ends of the Z-shaped structure is provided with one pressure roller shaft 163, and the pressure roller bracket is pivoted on the pressure roller shaft 163, and the auxiliary pressure roller 162 is mounted to a terminal end of the pressure roller bracket. The auxiliary pressure roller 162 is in contact with the tapered roller 21 through the roller slot 41 in the tapered cover plate 4. The pressure adjusting spring 165 has one end fixed to the pressure roller seat 161 and another end connected to the auxiliary pressure roller 162. The pressing force adjusting spring 165 is configured to adjust the pressure of the auxiliary pressure roller 162 acting on the tapered roller 21. The paper medium, when moving in the skew correcting passage, may be pressed and guided by the auxiliary pressure rollers 162 of the auxiliary pressure roller mechanism 16, thus may prevent the paper medium from separating from the surface of the tapered roller 21 due to a centrifugal effect of the movement in the skew correcting passage.

The process of correcting the paper medium skew by the paper medium skew correcting device is described as follows. The paper medium enters the horizontal passage interface 131 in the entrance leading passage 13 from other modules. Since it is required to turn by a certain angle when entering from the horizontal passage interface 131 to the paper medium skew correcting passage between the tapered cover plate 4 and the tapered roller 21, and at this time, the paper medium in the directions of a long edge and a short edge is at a respective certain angle with respect to the horizontal plane, therefore after the paper medium passes through the horizontal passage interface 131 and before it enters the skew correcting passage between the tapered roller 21 and the tapered cover plate 4, the inclined turning passage 132 which can achieve this turning function is required. In the horizontal passage interface 131, the banknote, under the action of the driving banknote picking roller 133 and the guide driven pinch roller 134, is entered into the inclined turning passage 132. The inside of the inclined turning passage 132 is a smooth curved surface, and the curved surface is tangent to the curved surface of the inside of the horizontal passage interface 131 at a position where the curved surface is connected to the horizontal passage interface 131, and the curved surface is tangent to the inner wall curved surface of the tapered cover plate 4 at a position where the curved surface is connected to the tapered roller 21, thus ensuring a smooth movement of the paper medium. Under the action of the turning driven pinch roller 135, the paper medium enters the paper medium skew correcting passage between the tapered cover plate 4 and the tapered roller 21. A driving motor 31 of the driving transmission assembly 3 drives the driving synchronous pulley 33 to rotate, and the synchronous pulley 33 drives the roller synchronous pulley 34, the driving banknote picking pulley 36, the driving banknote conveying pulley 37 and the tensioning guide synchronous pulley 35 to rotate by transmission of the synchronous belt. The roller synchronous pulley 34 is mounted on the tapered roller transmission shaft 23 which drives the tapered roller 21 to rotate. The skew of the paper medium during the conveying and moving process is corrected under the action of a resultant force generated by combined action of the centrifugal force and a rotational kinetic friction force of the tapered roller 21. When moving in the skew correcting passage, the paper medium may be pressed and guided by the auxiliary pressure rollers 162 of the auxiliary pressure roller mechanism 16, thus preventing the paper medium from separating from the surface of the tapered roller 21 due to being subjected to a centrifugal force when moving in the paper medium skew correcting passage. The pressure acting on the paper medium by the auxiliary pressure roller 162 may be adjusted by the pressing force adjusting spring 165 of the auxiliary pressure roller mechanism 16. Under the co-action of the centrifugal force and the friction force, the paper medium slides towards a large end of the tapered roller 21, and when fitting the end face reference plate 222 at the large end, the paper medium stops moving axially due to being blocked by the end face reference plate 222, thus achieving the skew correction to the paper medium during conveying and moving process. After the skew correction is achieved, the slant driven pinch roller 144 acts on the paper medium to prevent it from skewing again. Since in the subsequent processing, the paper medium is required to be in a horizontal state, the banknote is required to vary from the original skewed state to the horizontal state after skew is corrected and before the paper medium is outputted, therefore, the horizontal turning passage 141 between the tapered passage exit and the outward transfer horizontal passage 142 is required to turn the paper medium from an inclined state to a horizontal state. The inner wall of the horizontal turning passage 141 is a smooth curved surface, and the curved surface is tangent to the inner wall of the tapered cover plate 4 at the position where the curved surface is connected to the tapered cover plate 4, and the curved surface is tangent to the inner wall of the outward transfer passage 142 at the position where the curved surface is connected to the outward transfer passage 142, to ensure the smooth movement of the paper medium in the horizontal turning passage 141. Then the paper medium enters the horizontal turning passage 141 to be varied from being inclined to being horizontal, and enters the outward transfer horizontal passage 142, and the skew-corrected medium is outputted with the power provided by the driving delivery roller 143.

Accordingly, a paper medium skew correcting method according to the present embodiment includes the following three steps. In step 1, a paper medium to be skew-corrected enters the entrance leading passage 13 of the above paper medium skew correcting device, and enters the paper medium skew correcting passage between the tapered cover plate 4 and the tapered roller 21 via the horizontal passage interface 131 and the inclined turning passage 132. In step 2, the paper medium slides towards the large end of the tapered roller 21 under the co-action of the centrifugal force and the rotational kinetic friction force of the tapered roller 21, and when an edge of the paper medium fits the large end surface reference plate 222, the paper medium stops moving axially due to being blocked by the large end surface reference plate 222, thus achieving the skew correction to the paper medium during conveying and moving process. In step 3, the paper medium enters the outward transfer horizontal passage 142 via the horizontal turning passage 141, thus the skew-corrected paper medium is outputted. Preferably, in step 1, the paper medium in the horizontal passage interface 131 is entered into the inclined turning passage 132 under the action of the driving banknote picking roller 133 and the guide driven pinch roller 134, and then is entered into the paper medium skew correcting passage between the tapered cover plate 4 and the tapered roller 21 under the action of the turning driven pinch roller 135. In step 3, when the paper medium enters the horizontal turning passage 141 from the skew correcting passage, the slant driven pinch roller 143 acts on the paper medium to prevent the paper medium from being skewed again, and the driving delivery roller 144 provides power to output the skew-corrected paper medium. Preferably, in step 2, the auxiliary pressure roller mechanism 16 acts on the surface of the tapered roller 21, to apply a pressure on the paper medium passing through the paper medium skew correcting passage and guide the paper medium, to prevent the paper medium from separating from the outer surface of the tapered roller 21 due to the action of the centrifugal force generated when the paper medium moves in the skew correcting passage.

The paper medium skew correcting device according to the present application adopts the tapered roller assembly to achieve skew correction of banknotes. The tapered roller and the tapered cover plate in the tapered roller assembly cooperate to form the paper medium skew correcting passage. The power for the banknotes moving in the skew correcting passage is only provided by the driving transmission assembly. Since the skew correcting passage formed by the tapered roller and the tapered cover plate is around the tapered roller, the skew correcting passage does not occupy a large space in the horizontal direction, and the tapered roller has a simple structure and is easy to assemble. Therefore, the paper medium skew correcting device according to the present application effectively simplifies the structure, reduces the manufacturing and assembling costs of the products, and fully utilizes the co-action of the centrifugal force and friction force generated in the movement of the paper medium along with the tapered roller to achieve skew correction and conveying of the paper medium, thereby fundamentally overcoming the technical issue of jam of the valuable paper medium in the device due to a too large skew correcting force. Also, since the structure is simplified, the device can effectively reduce the volume, and facilitates the integration of the device in other apparatuses such as ATMs, and the cash counter.

The embodiments described hereinabove are only preferred embodiments of the present application, and should not be interpreted as limitation to the protection scope of the present application, and the protection scope of the present application should be defined by the claims. For those skilled in the art, several improvements and modifications can be made without departing from the spirit and scope of the present application, and these improvements and modifications should also be considered as the protection scope of the present application.

The invention claimed is:

1. A paper medium skew correcting device, comprising:

a support comprising a pair of fixed stop plates arranged in parallel;

a skew correcting tapered roller assembly comprising a tapered roller, a reference plate located at a large end face of the tapered roller and a tapered roller transmission shaft, wherein the skew correcting tapered roller assembly is connected to transmission shaft mounting holes of the pair of fixed stop plates on a left side and a right side by the tapered roller transmission shaft;

a tapered cover plate covering on the tapered roller, wherein a paper medium skew correcting passage is formed between an inner wall of the tapered cover plate and an outer wall of the tapered roller, an auxiliary pressure roller mechanism is mounted on an outer wall of the tapered cover plate and is configured to press a paper medium in the skew correcting passage against the outer wall of the tapered roller tightly, and the tapered cover plate is provided with an opening for the auxiliary pressure roller mechanism to elastically press the tapered roller tightly; and a driving transmission assembly for providing power to the tapered roller, an entrance leading passage, wherein the entrance leading passage comprises a horizontal passage interface and an inclined turning passage, an inner wall of the inclined turning passage is a smooth curved surface and is tangentially connected to an inner wall of the horizontal passage and the inner wall of the tapered cover plate, wherein the entrance leading passage further comprises a driving banknote picking roller, a guide driven pinch roller and a turning driven roller in the listed sequence in a conveying direction of the paper medium, the driving banknote picking roller is connected to the pair of fixed stop plates on the two sides by a fixed shaft, the driving banknote picking roller is in contact with the guide driven pinch roller through a roller slot in the horizontal passage interface, and the turning driven pinch roller is connected to the pair of fixed stop plates on the two sides by an inclined shaft, and the turning driven pinch roller is in contact with the tapered roller through a roller slot in the inclined turning passage.

2. The paper medium skew correcting device according to claim 1, further comprising an exit transfer passage, wherein the exit transfer passage comprises a horizontal turning passage and an outward transfer horizontal passage, an inner wall of the horizontal turning passage is a smooth curved surface and is tangentially connected to the inner wall of the tapered cover plate and the outward transfer passage.

3. The paper medium skew correcting device according to claim 2, wherein the exit transfer passage further comprises a driving delivery roller and a slant driven pinch roller, the driving delivery roller is connected to the pair of fixed stop plates on the left side and the right side by a shaft, and the driving delivery roller is in contact with an inner wall of the outward transfer horizontal passage through a roller slot in the outward transfer horizontal passage; and the slant driven pinch roller is connected to the pair of fixed stop plates on the left side and the right side by an inclined shaft, and the slant driven pinch roller is in contact with the tapered roller through a roller slot in the tapered cover plate.

4. A paper medium skew correcting method, comprising:

step 1, entering a paper medium to be corrected into the entrance leading passage of the paper medium skew correcting device according to claim 3, and entering the paper medium into the paper medium skew correcting passage between the tapered cover plate and the tapered roller via the horizontal passage interface and the inclined turning passage;

step 2, sliding, by a co-action of a centrifugal force and a rotational kinetic friction force of the tapered roller, the paper medium towards a large end of the tapered roller, and when an edge of the paper medium fits the reference plate, the paper medium stops moving axially due to being blocked by the reference plate, thus achieving the skew correction to the paper medium during conveying and moving process; and step 3, entering the paper medium into the outward transfer passage via the horizontal turning passage, thus outputting the skew-corrected paper medium.

5. The paper medium skew correcting method according to claim 4, wherein in step 1, the paper medium in the horizontal passage interface is entered into the inclined turning passage under the action of the driving banknote picking roller and the guide driven pinch roller, and then is entered into the paper medium skew correcting passage between the tapered cover plate and the tapered roller under the action of the turning driven pinch roller; and in step 3, when the paper medium is entered into the horizontal turning passage from the skew correcting passage, the slant driven pinch roller acts on the paper medium to prevent the paper medium from being skewed again, and the driving delivery roller provides power to output the skew-corrected paper medium.

6. The paper medium skew correcting method according to claim 4, wherein in step 2, the auxiliary pressure roller mechanism acts on the surface of the tapered roller, to apply a pressure on the paper medium passing through the paper medium skew correcting passage and guide the paper medium, to prevent the paper medium from separating from the outer surface of the tapered roller due to the action of the centrifugal force generated when the paper medium moves in the skew correcting passage.

7. A financial self-service apparatus, comprising:

a banknote access slot for depositing and/or withdrawing of banknotes;

a banknote receiving box for storing banknotes; and a banknote conveying passage configured to connect the banknote access slot and the banknote receiving box and convey banknotes, wherein the banknote conveying passage is provided with the paper medium skew correcting device according to claim 3.

8. A financial self-service apparatus, comprising:

a banknote access slot for depositing and/or withdrawing of banknotes;

a banknote receiving box for storing banknotes; and a banknote conveying passage configured to connect the banknote access slot and the banknote receiving box and convey banknotes, wherein the banknote conveying passage is provided with the paper medium skew correcting device according to claim 2.

9. The paper medium skew correcting device according to claim 1, wherein the auxiliary pressure roller mechanism comprises a pressure roller seat and an auxiliary pressure roller, a pressure roller shaft and a pressing force adjusting spring;

the auxiliary pressure roller mechanism is mounted to a fitting hole of the tapered cover plate via the pressure roller seat, the auxiliary pressure roller is in contact with the tapered roller through a roller slot in the tapered cover plate, the pressing force adjusting spring has one end fixed to the pressure roller seat and another end connected to the auxiliary pressure roller, and the pressing force adjusting spring is configured to adjust a pressure applied to the tapered roller by the auxiliary pressure roller.

10. A financial self-service apparatus, comprising:

a banknote access slot for depositing and/or withdrawing of banknotes;

a banknote receiving box for storing banknotes; and a banknote conveying passage configured to connect the banknote access slot and the banknote receiving box and convey banknotes, wherein the banknote conveying passage is provided with the paper medium skew correcting device according to claim 9.

11. A financial self-service apparatus, comprising:

a banknote access slot for depositing and/or withdrawing of banknotes;

a banknote receiving box for storing banknotes; and a banknote conveying passage configured to connect the banknote access slot and the banknote receiving box and convey banknotes, wherein the banknote conveying passage is provided with the paper medium skew correcting device according to claim 1.

* * * * *